US006032741A

United States Patent [19]

Johnson

[11] Patent Number: 6,032,741

[45] Date of Patent: Mar. 7, 2000

[54] ABRASIVES FOR WELL CLEANING

[75] Inventor: Ashley Bernard Johnson, Sugar Land, Tex.

[73] Assignee: Schlumberger Technology Corporation, Sugar Land, Tex.

[21] Appl. No.: 08/988,492

[22] Filed: Dec. 10, 1997

[30] Foreign Application Priority Data

May 14, 1997 [GB] United Kingdom ..... 9709635

[51] Int. Cl.[7] ..... F21B 37/00

[52] U.S. Cl. ..... 166/312

[58] Field of Search ..... 166/312, 376; 51/298, 309

[56] References Cited

U.S. PATENT DOCUMENTS

| | | | |
|---|---|---|---|
| 3,866,683 | 2/1975 | Maly et al. . | |
| 4,442,899 | 4/1984 | Zublin | 166/312 |
| 4,537,604 | 8/1985 | Dawson | 51/298 |
| 5,160,547 | 11/1992 | Kirschner et al. . | |
| 5,308,404 | 5/1994 | Yam et al. . | |

FOREIGN PATENT DOCUMENTS

| | | |
|---|---|---|
| 220 815 A1 | 4/1985 | Germany . |
| 2203776 | 3/1988 | United Kingdom . |
| WO 91/11270 | 8/1991 | WIPO . |
| WO 94/07658 | 4/1994 | WIPO . |

OTHER PUBLICATIONS

Notification of Transmittal of the International Search Report or the Declaration.

International Search Report including EPO Patent Abstracts of Japan, Publication Nos. 57015671 and 57092521.

Derwent Search Report No. AN–89–124789.

"Combined Search and Examination Report", U.K. Patent Office, Cardiff Road, Newport, Gwent NP9 1RH, Jul. 30, 1997.

*Primary Examiner*—William Neuder
*Attorney, Agent, or Firm*—Douglas Y'Barbo; Robin C. Nava

[57] ABSTRACT

Novel abrasive particles for cleaning subterranean wellbores are described. The particles are rounded, preferably spherical, and has a hardness of 80 to 200 Vickers. The particles are preferably made of non-metallic material such as Calcite pellets. The new abrasives cause significantly less damage to the well tubulars than sand.

20 Claims, 2 Drawing Sheets

ABRASIVES FOR WELL CLEANING

The present invention relates to abrasives and an improved method for cleaning a hydrocarbon well using a fluid jet loaded with said abrasives.

BACKGROUND OF THE INVENTION

It has been common practice for many years to run a continuous reeled pipe (known extensively in the industry as "coil tubing") into a well to perform operations utilising the circulation of treating and cleanout fluids such as water, oil, acid, corrosion inhibitors, hot oil, nitrogen, foam, etc. Coil tubing, being continuous rather than jointed, is run into and out of a well with continuous movement of the tubing through a coil tubing injector.

Coil tubing is frequently used to circulate cleanout fluids through a well for the purpose of eliminating sand bridges, scale, and similar downhole obstructions. Often such obstructions are very difficult and occasionally impossible to remove because of the inability to rotate the coil tubing and drill out such obstructions. These well tubulars vary from unperforated and perforated pipe, large diameter casing, production tubing, and slotted or wire-wrapped well liner. Well tubulars often become plugged or coated with corrosion products, sediments and hydrocarbon deposits. The deposits may consist of silicates, sulphates, sulphide, carbonates, calcium, and organic growth.

It is desirable to perform drilling type operations in wells through use of coil tubing which can be run into and removed from a well quickly in addition to performing the usual operations which require only the circulation of fluids. The same types of well servicing can also be performed with various small diameter work strings. The present invention may be used with such work strings and is not limited to coil tubing.

High pressure fluid jet systems have been used for many years to clean the inside diameter of well tubulars. Examples of such systems are disclosed in the following U.S. Pat. Nos.: 3,720,264, 3,811,499, 3,829,134, 3,850,241, 4,088,191, 4,349,073, 4,441,557, 4,442,899, 4,518,041, 4,919,204, 5,181,576 or 5,337,819.

The abrasive of choice in current practice of well cleaning is sand, though other abrasive particless are known from different technical fields. For example, the use of non-spherical flint or steel shot is disclosed in the U.S. Pat. No. 4,482,392. The hardness of the material described is well above 50 on a Rockwell C scale.

A well cleaning method using coiled tubing is described in the International Patent Application WO 91/11270. It comprises the use of an abrasive mixture of carrier fluid and abrasive particles, a pumping system to pressurise said mixture and coiled tubing unit with a jetting head. The abrasive is characterised as rounded and its effect on the pipes is described as being confined to a beneficial shot-peening action. No specific example of such an abrasive is given.

In view of the above cited prior art it is an object of the invention is to provide a improved abrasive for well cleaning applications.

SUMMARY OF THE INVENTION

The objects of the invention are achieved by abrasives and methods as set forth in the appended independent claims.

The abrasive particles in accordance with the invention are round and have a hardness of 80 to 200 Vickers (as measured with a 50 g load). This value is below the hardness of the steel shot disclosed in the U.S. Pat. No. 4,482,392 referred to above.

It was found that the novel abrasives, while effectively removing scale, cause only limited erosion of the well tubulars.

The erosion of the well tubulars can be limited further by ensuring that the abrasive particles are essentially spherical. Essentially spherical in the context of this invention is defined as having no systematic preferential shape other than an ideal sphere, even though each single particle may deviate more or less from that shape.

It was further found that the removal of the solid deposits can be accelerated by choosing material from within the range of 120 to 190 Vickers, even more preferably from within the range of 155 to 185 Vickers.

Furthermore, preferred abrasives in accordance with the invention have a material or SG density of more than 2000 $kg/m^3$, more preferably in the range of 2000 $kg/m^3$ to 5000 $kg/m^3$. It should be noted that the density given refers to the density of a single pellet of the abrasive material.

The abrasives are preferably selected from non-metallic materials, such as minerals or ceramics.

Ceramics can be for example clay type particles which are produced by processes which include rolling and spray drying to make spherical shape. The requisite hardness can then be generated by calcining to temperature for specified period.

Minerals are taken from earth deposits as rock, then crushed to produce particles. These particles (e.g. Calcite, Dolomite, Barite) can be acquired with the right size and hardness, but usually tend to be angular. However using for example a wet rolling process, it is possible to produce spherical particles.

Materials like Calcium, Barium, and Zinc or derivatives, thereof, such as Sulphates, Carbonates, Phosphates can be produced as spherical particles by precipitation, or in rotary bomb type reactors. They have the correct hardness and can be made in the correct shape and size. Importantly pellet reactors are used for reduction of Carbonate ($CaCO_3$) or Phosphate levels in cold water. These produce spherical particles with the correct properties (including particles normally known as Calcite Pellets, comprising precipitated Calcium Carbonate) Calcite Pellets are specifically advantageous for the purpose of this invention as they are available in large quantities and for economical prices.

Furthermore, the pellets are preferably graded so as to select a size range of 0.1 mm to 1 mm diameter.

It should be noted that the abrasives in accordance with the present invention are rounded so as to limit the damage to the steel tubulars to be cleaned. If however such damage is tolerable the above-mentioned materials, specifically the calcite based materials could also be used in other, e.g. angular, shapes.

These and other features of the invention, preferred embodiments and variants thereof, and advantages will become appreciated and understood by those skilled in the art from the detailed description and drawings following hereinafter.

MODE(S) FOR CARRYING OUT THE INVENTION

The invention is now described with reference to the attached drawings.

The respective performance of different abrasive materials was tested using a standard testing set-up. The results of which are illustrated by FIGS. 1 and 2.

For the tests, a 2.5% (by weight) water—abrasive mixture was prepared. The tested materials included Olivine with Vickers hardness of around 700, Dolomite (hardness: 200) and Calcite (hardness: 150), as well as graded Calcite pellets (hardness: 180) with spherical shape.

The slurries were pumped through a nozzle of 2.8 mm diameter at a pressure of 180 bars (18 MPa) (jet speed approximately 200 m/s). The jet was targeted at a steel plate and, after the jetting, the hole depth was measured to quantify the damage caused by the abrasives.

Figure 1:
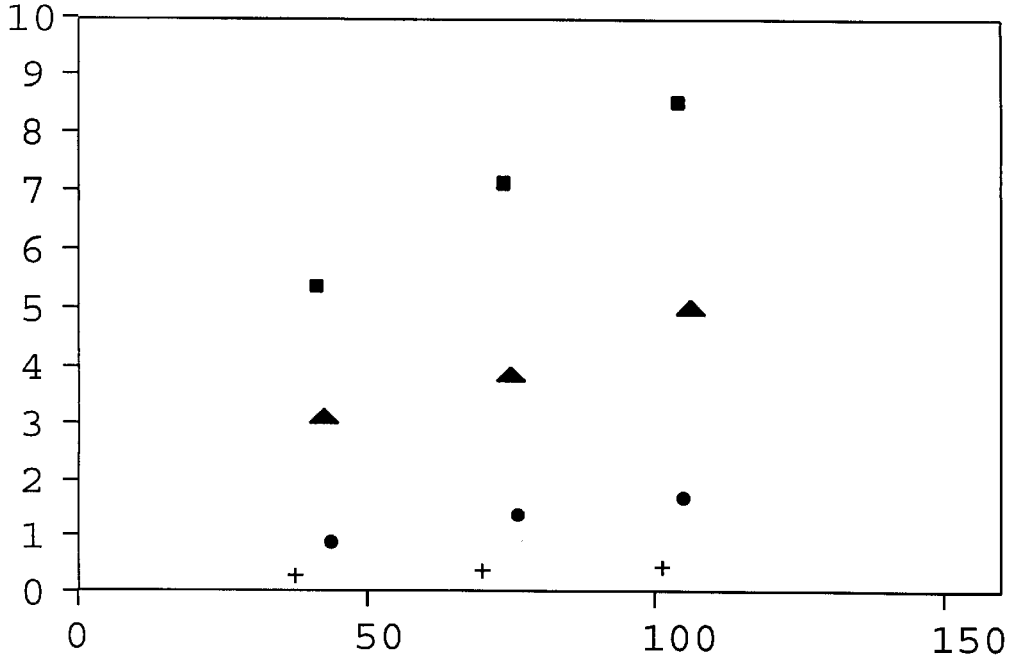
FIG. 1 illustrates the erosion of steel in dependence of jet time for various abrasives.
Figure 2:
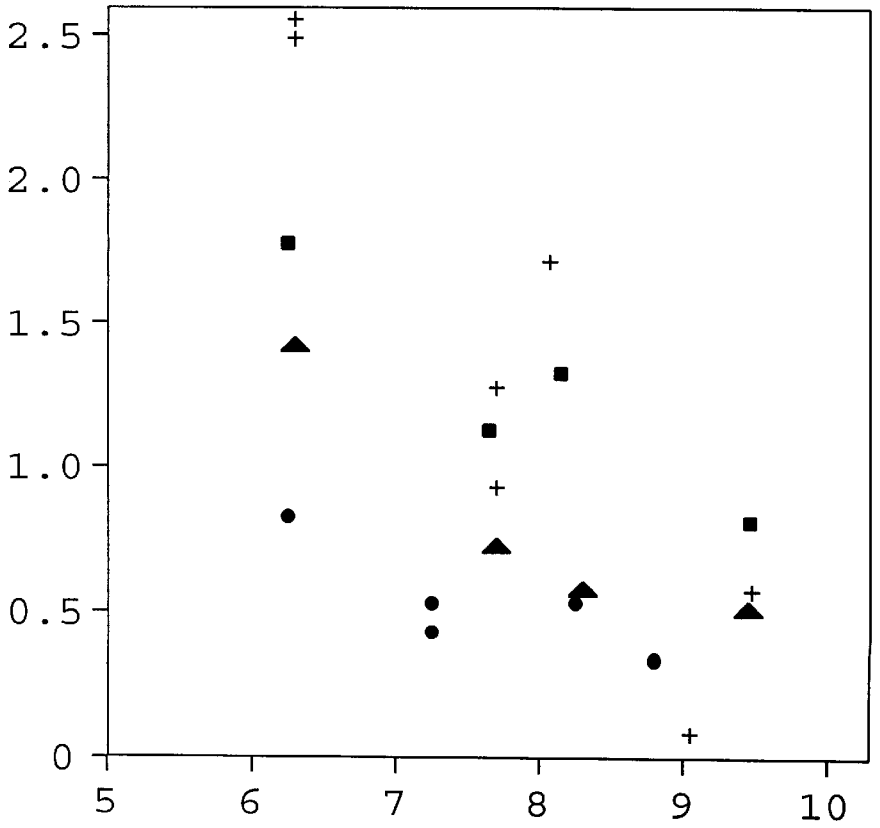
FIG. 2 illustrates the removal of deposits in dependence of shot distance for various abrasives.

The results illustrated by FIG. 1 were measured at a constant distance (stand-off) between jet nozzle and steel plate of 15 mm. The jetting time varied between 40 and 105 seconds (as marked on the abscissa). The measured hole depth in the steel plate (in mm) is marked on the ordinate.

Results related to Olivine slurry are labelled by squares, those for Dolomite with a triangle, and for Calcite and the Calcite pallets with circles and crosses, respectively.

Notably the damages caused by the rounded pellets are about an order of magnitude smaller that those cause by the angular Olivine (sand) and still less that the damages caused by the angular Calcite, which has approximately the same or even a lesser hardness.

The efficacy of the abrasives regards the removal of deposits was tested on a Barium Sulphate sample. Barium Sulphate, together with Calcium Sulphate and Calcium Carbonate, is a typical component of well deposits (scales). During these tests, illustrated by FIG. 2, the jet travelled in a circular path over the Barium Sulphate at a constant speed of 60 mm/s, while the stand-off varied between 6 and 10 nozzle diameter (2.4 and 3.2 mm) (on the abscissa). The ordinate shows a normalised groove depth. Results for the different materials are labelled as in FIG. 1.

Surprisingly, the Calcite Pellets displayed a higher cutting rate than even the much harder and angular Olivine sample, even though the performance at increased stand-offs seemed to drop off at a faster rate. Also, the performance of the pellets compared favourably with that of the angular calcite and Dolomite.

Other possible abrasive material may comprise steel shots annealed to control their hardness. This material shows a performance similar to the Calcite Pellets, however, it is significantly more expensive and heavier. Another alternative could be beads of plastic material loaded with a heavier mineral, typically Barium Sulphate.

Figure 3:
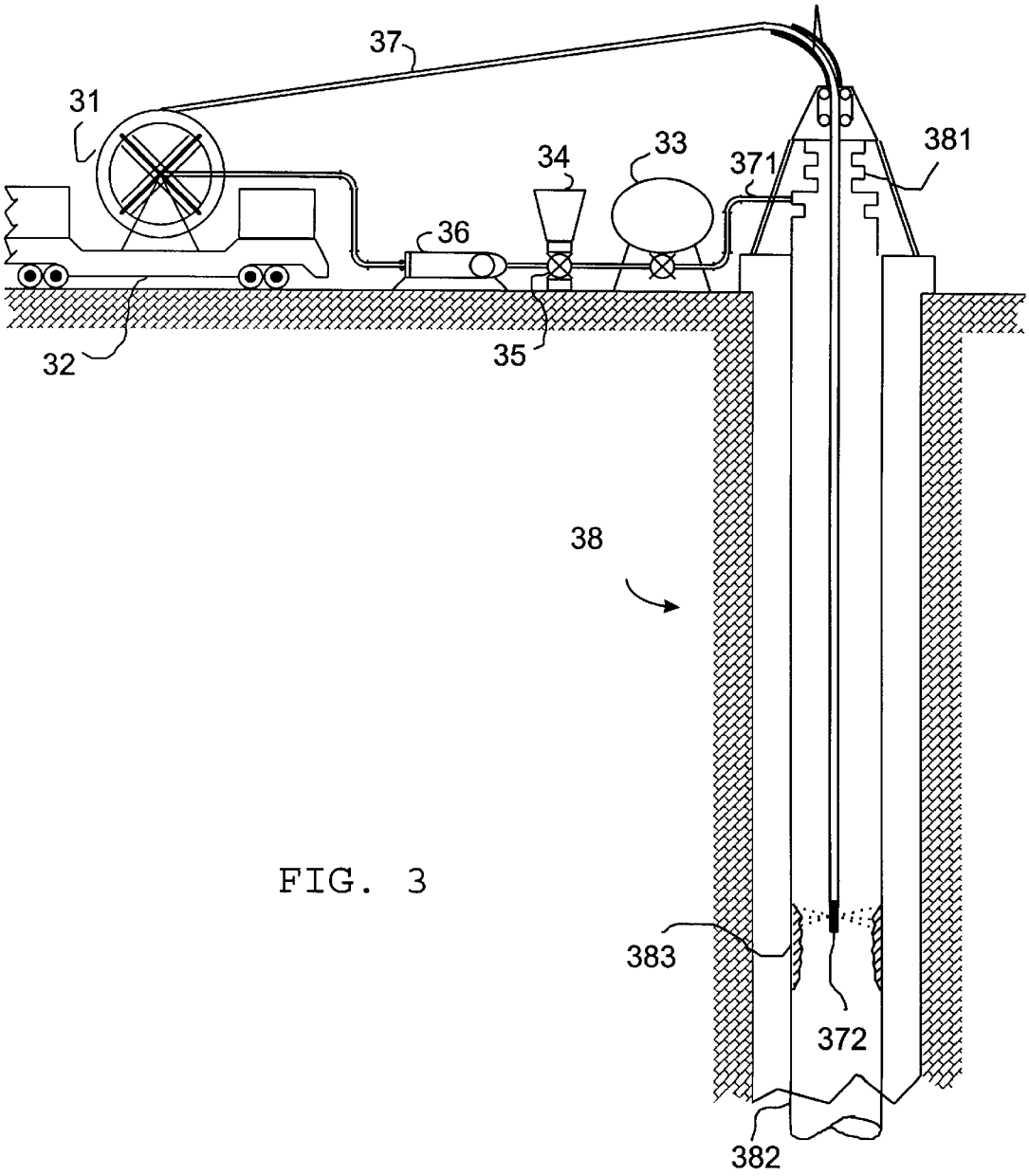
FIG. 3 schematically shows a jet cleaning tool.

Typical applications of the novel abrasives include well cleaning operations as illustrated by FIG. 3. The subsurface equipment for well cleaning comprises a coiled tubing reel 31 usually mounted on a truck 32. Connected to the reel there is a cleaning fluid tank 33, a reservoir and feeder for the abrasive material 34. A mixer 35 generates the abrasive slurry applied for deposit removal. A pump unit 36 generates the pressure to circulate the slurry through the coiled tubing 37 and the wellbore 38.

The coiled tubing 37 is fed through the Blow-out Preventer (BOP) stack 381 into the well tubulars 382. A return pipe 371 at the upper end of the well tubulars closes the flow loop through which the cleaning fluid is pumped. Also included in the flow loop (but not shown) are separators to recover the cleaning fluid and/or the abrasives.

In operation, the coiled tubing with a jetting head 372 at its end is lowered into the well 38 to a predetermined depth at which deposits 383 are to be removed. Then the abrasive containing slurry is discharged through the nozzles of the jetting head removing scale at a rate depending on the deposits, jetting speed and stand-off.

I claim:

1. Abrasive particles for the in situ removal of scale or other wellbore/casing deposits by impingement of said particles on said scale or deposits, said particles having the following characteristics:

rounded hardness of 80 to 200 Vickers.

2. The particles of claim 1, characterised in that said particles have an essentially spherical shape.

3. The particles of claim 1, characterised in that said particles have a diameter of 0.1 to 1 mm.

4. The particles of claim 1, characterised in that said particles have a material density of more than 2000 kg/m$^3$.

5. The particles of claim 1, characterised in that said particles consist of non-metallic material.

6. The particles of claim 1, characterised in that said particles comprise mineral or ceramic materials.

7. The particles of claim 1, characterised in that said particles comprise Sulphates, Carbonates, Phosphates or other derivatives of Calcium, Barium or Zinc.

8. The particles of claim 1, characterised in that said particles comprise Calcite pellets.

9. Method for the in situ removal of scale or other wellbore/casing deposits by impingement of said particles or said scale or deposits comprising the steps of lowering a nozzle head mounted on a part of a lower end of a hollow tubular into said well; and pressurizing a fluid to be discharged through said nozzle head at a predetermined location in the well, wherein the fluid comprises abrasive particles in accordance with claim 1.

10. Abrasive particles for the in situ removal of scale or other wellbore/casing deposits by impingement of said particles on said scale or deposits, said particles having the following characteristics:

generally spherical shape;

about 0.1 mm to about 1.0 mm in diameter; and a hardness of about 120 to about 190 Vickers.

11. The abrasive particles of claim 10 wherein said particles consist essentially of calcite.

12. The abrasive particles of claim 10 having a hardness of between about 155 and about 185 Vickers.

13. The abrasive particles of claim 10 where said particles consist essentially of one or more minerals.

14. The abrasive particles of claim 10 wherein said particles consist essentially of a ceramic material.

15. The abrasive particles of claim 10 wherein said particles consist essentially of olivine.

16. A method for removing scale or other deposits from a well casing, comprising:

injecting into a well a device for discharging a pressurized slurry comprising the abrasive particles of claim 10, against said well casing.

17. A method for removing scale or other deposits from a well casing, comprising:

injecting into a well a device for discharging a pressurized slurry comprising the abrasive particles of claim 11 against said well casing.

18. A method for removing scale or other deposits from a well casing, comprising:

injecting into a well a device for discharging a pressurized slurry comprising the abrasive particles of claim 12 against said well casing.

19. A method for removing scale or other deposits from a well casing, comprising:

injecting into a well a device for discharging a pressurized slurry comprising the abrasive particles of claim 16 against said well casing.

20. Abrasive particles for in situ removal of scale or other deposits by impingement of said particles on said scale or deposits from a well casing, said particles having the following characteristics:

generally spherical shape;

about 0.1 mm to about 1.0 mm in diameter;

a hardness of about 120 to about 190 Vickers; and consisting essentially of calcite.

* * * * *